US006032332A

United States Patent [19]

Lin

[11] Patent Number: 6,032,332

[45] Date of Patent: Mar. 7, 2000

[54] TOOL HANDLE HAVING A TOOL RECEIVING STRUCTURE

[76] Inventor: Hua Yi Lin, 3F-1, No. 50, Hsin Da Road, Taichung, Taiwan

[21] Appl. No.: 09/067,739

[22] Filed: Apr. 28, 1998

[51] Int. Cl.[7] ..... A47B 95/02; B25G 1/08

[52] U.S. Cl. ..... 16/111.1; 81/177.4; 81/490

[58] Field of Search ..... 16/111.1, 436; 81/177.4, 490, 489, 439

[56] References Cited

U.S. PATENT DOCUMENTS

| | | | |
|---|---|---|---|
| 4,328,721 | 5/1982 | Massari | 81/439 |
| 4,480,668 | 11/1984 | Lin | 145/63 |
| 5,174,178 | 12/1992 | Disston, Jr. | 81/490 |
| 5,740,706 | 4/1998 | Tseng | 81/490 |
| 5,881,615 | 3/1999 | Dahl et al. | 81/490 |

*Primary Examiner*—Anthony Knight
*Assistant Examiner*—Alison K. Pickard

[57] ABSTRACT

A tool handle includes a housing having a chamber and a slot communicating with the chamber. A rod is rotatably receiving in the chamber and has a number of channels for receiving tool bits. A lid is engaged with the slot of the housing and biased to engage with the housing and may be depressed inward of the housing. The rod may be rotated to align the required tool bit with the lid for allowing the tool bit to be tilted by the lid and to be easily fetched by the user. A control ferrule is secured to the rod for rotating the rod and for aligning the tool bit with the lid.

9 Claims, 3 Drawing Sheets

TOOL HANDLE HAVING A TOOL RECEIVING STRUCTURE

BACKGROUND OF THE INVENTION

1. Field of the Invention

The present invention relates to a tool handle, and more particularly to a tool handle having a tool receiving structure for receiving tool bits.

2. Description of the Prior Art

Typical tool handles, particularly the handles for screw drivers, comprise a chamber for receiving a number of tool bits. However, the tool bits may not be easily fetched.

The present invention has arisen to mitigate and/or obviate the afore-described disadvantages of the conventional tool handles.

SUMMARY OF THE INVENTION

The primary objective of the present invention is to provide a tool handle having a tool receiving structure for allowing the tool bits to be easily engaged into and disengaged from the tool handle.

In accordance with one aspect of the invention, there is provided a tool handle comprising a housing including a chamber and a slot communicating with the chamber, a rod rotatably receiving in the chamber and including at least one channel, at least one tool bit engaged in the channel of the rod, a lid engaged with the slot of the housing and including a first end, and means for biasing the first end of the lid to engage with the housing, the first end of the lid being allowed to be depressed inward of the housing against the biasing means. The rod is allowed to be rotated to align the tool bit with the lid, and the tool bit is allowed to be tilted by the lid when the first end of the lid is depressed inward of the housing against the biasing means.

The lid includes a block provided in the first end and includes a pair of shoulders for engaging with the housing, the biasing means biases the block to engage with the housing for allowing the block and the first end of the lid to be depressed inward of the housing. The rod includes an extension extended outward of the housing. A control ferrule is secured to the extension for rotating the rod and for aligning the tool bit with the lid. A cap is rotatably secured to the control ferrule for shielding the extension.

The housing includes a resilient retainer, the rod includes a cavity rotatably engaging with the retainer for allowing the retainer to rotatably secure the rod to the housing.

The lid includes a second end having a projection, the rod includes a first end having a head, the head includes an outer peripheral surface having at least one depression for engaging with the projection of the lid and for positioning the rod relative to the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
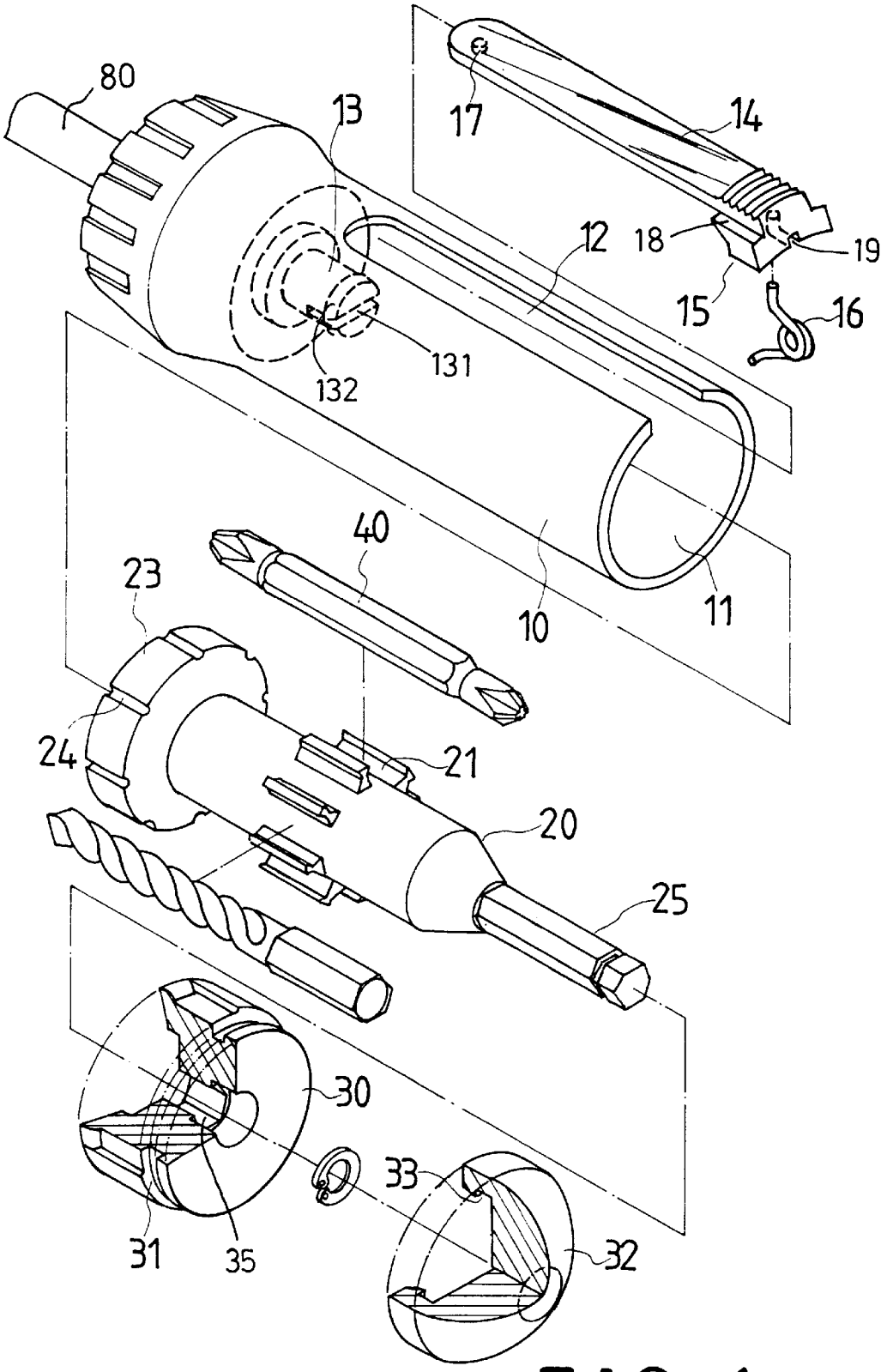
FIG. 1 is an exploded view of a tool handle in accordance with the present invention.
Figure 2:
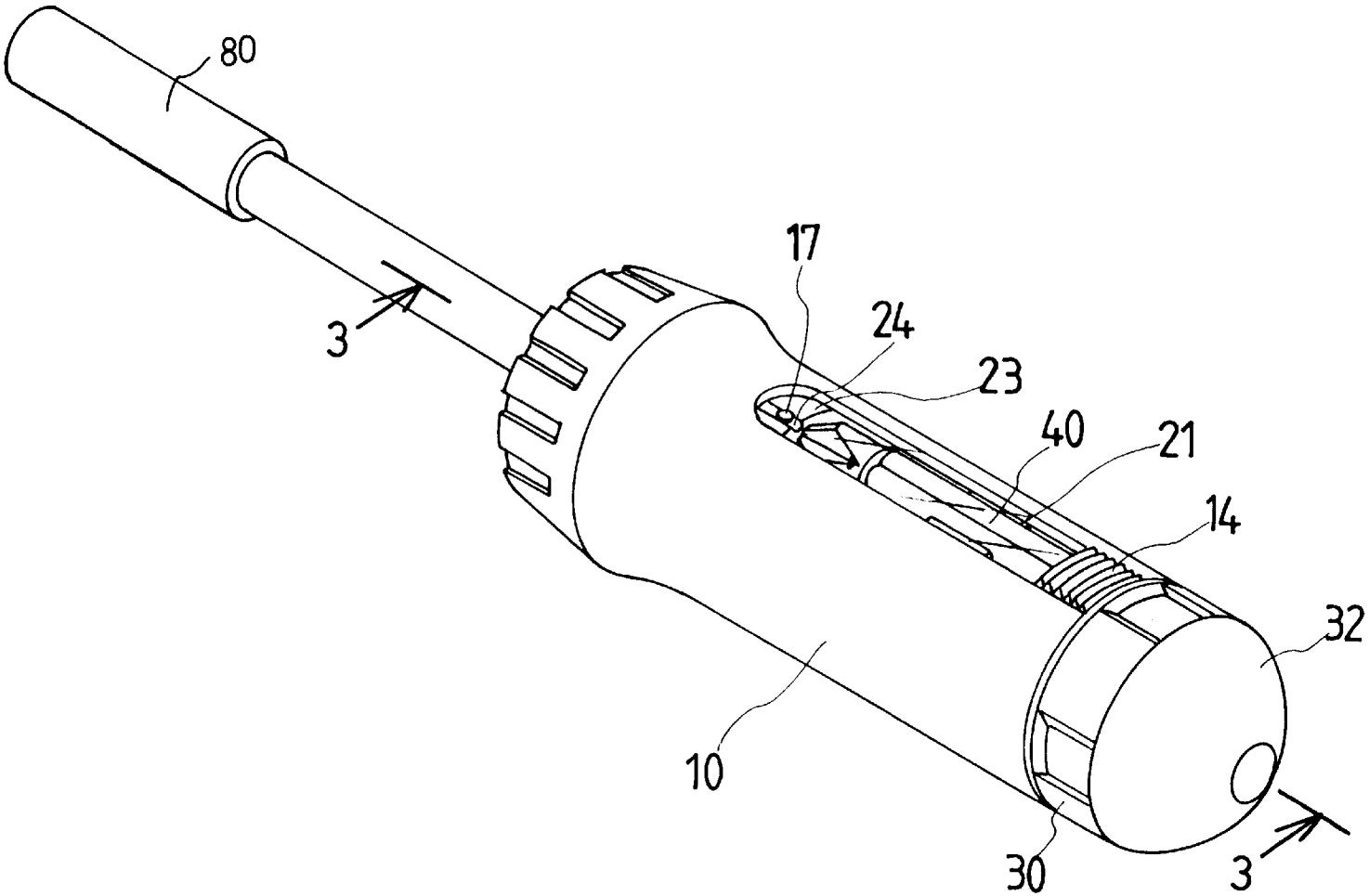
FIG. 2 is a perspective view of the tool handle.
Figure 3:
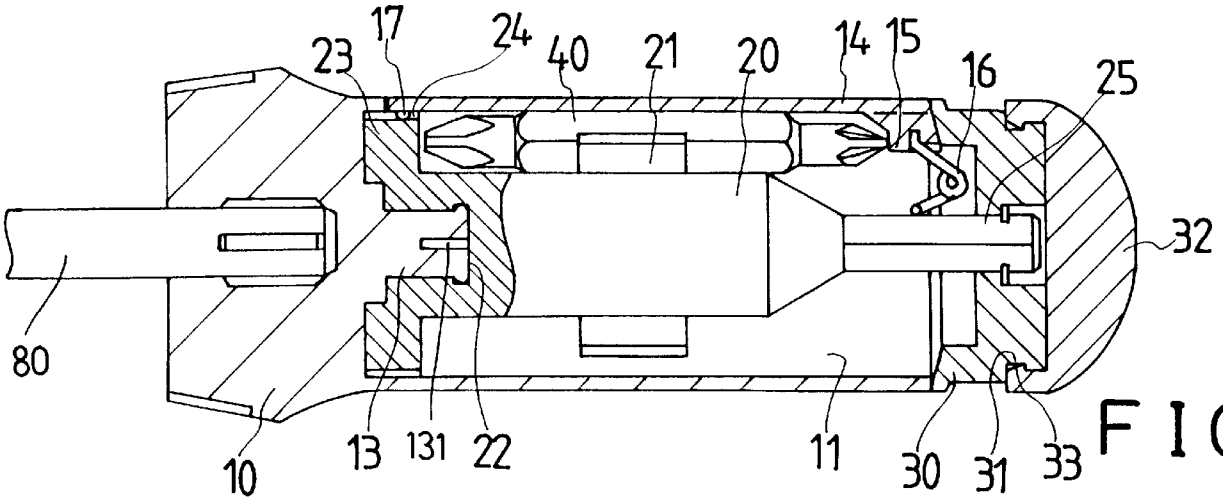
FIG. 3 is a cross sectional view taken along lines 3—3 of FIG. 2.

Referring to the drawings, and initially to FIGS. 1–3, a tool handle in accordance with the present invention comprises a housing 10 including a chamber 11 formed therein and including a slot 12 communicating with the chamber 11. A driving stem 80 is secured to the housing 10 for engaging with and for driving the fasteners, such as screws or nuts or the like. A pin 13 is disposed in the housing 10 and includes a slit 131 for forming a resilient retainer. A lid 14 is engaged with the slot 12 and includes a block 15 secured to one end and includes a pair of shoulders 18 for engaging with the housing 10. The lid 14 includes a projection 17 formed on the other end opposite to the block 15. It is preferable that the lid 14 is made of transparent materials.

A rod 20 is rotatably engaged in the chamber 11 of the housing 10 and has a cavity 22 rotatably engaged with the retainer 13. The retainer 13 includes an annular rib 132 for engaging with a corresponding annular groove of the rod 20 for rotatably securing the rod 20 in the housing 10. The rod 20 includes a number of channels or clamping members 21 for engaging with and for securing the tool bits 40 in place. The rod 20 includes a head 23 secured to one end and having a number of depressions 24 provided on the outer peripheral surface and aligning or corresponding to the channels or the clamping members 21 of the rod 20. The rod 20 includes an extension 25 extended outward of the housing 10. A control ferrule 30 is engaged with the extension 25 by such as a force-fitted engagement for allowing the control ferrule 30 to rotate the rod 30. The control ferrule 30 may include a bore 35 having a non-circular cross section for engaging with the extension 25 having the corresponding non-circular cross section, such that the extension 25 may also be rotated by the control ferrule 30 without the force-fitted engagement. The control ferrule 30 includes an annular recess 31. A cap 32 includes an annular flange 33 for engaging with the annular recess 31 and for rotatably securing to the control ferrule 30. The cap 32 may be used for shielding the extension 25.

Figure 4:
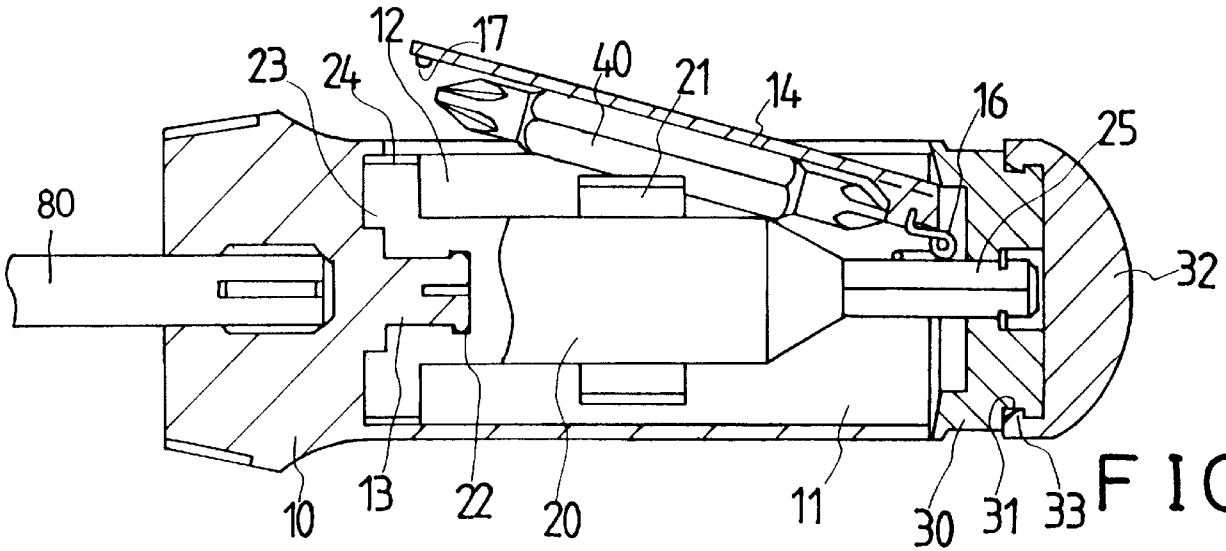
FIG. 4 is a cross sectional view similar to FIG. 3, illustrating the operation of the tool handle.

A spring 16 has one end engaged with a hole 19 of the block 15 and has one end biased against the extension 25 for biasing the block 15 to engage with the housing 10 and for allowing the block 15 to be depressed inward of the housing 10 against the spring 16. The required tool bit 40 may be rotated to be aligned with the lid 14 by the rod 20 and the control ferrule 30 (FIGS. 2, 3). When the block 15 is depressed inward of the housing 10, as shown in FIG. 4, the tool bit 40 may also be tilted for allowing one end of the tool bit 40 to be extended or exposed outward of the housing 10 and for allowing the tool bit 40 to be easily fetched by the user. The projection 17 of the lid 14 may engage with the corresponding depressions 24 for retaining the rod 20 in place and for positioning the selected tool bit 40 relative to the lid 14. When the control ferrule 30 is rotated, the projection 17 may be forced away from the depressions 24 and may be biased to engage with the other depressions 24 again by the spring 16 when the projection 17 is aligned with the other depressions 24. The one end of the spring 16 may be solidly secured to the block 15 by such as force-fitted engagement or by adhesive materials, such that the other end of the spring 16 will not be disengaged from the extension 25 when the extension 25 is rotated relative to the spring 16.

In operation, as shown in FIGS. 2, 3, the control ferrule 30 may be rotated for aligning the required tool bit 40 with the transparent lid 14. At this moment, as shown in FIG. 4, one end of the lid 14 and the block 15 are depressed inward of the housing 10 against the spring 16 for tilting the tool bit 40 and for allowing the tool bit 40 to be easily disengaged from or engaged into the housing 10.

Accordingly, the tool handle in accordance with the present invention includes a tool receiving structure for allowing the tool bits to be easily engaged into and disengaged from the tool handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool handle comprising:

a housing including a chamber and a slot communicating with said chamber, a rod rotatably receiving in said chamber and including at least one channel, at least one tool bit engaged in said at least one channel of said rod, a lid engaged with said slot of said housing and including a first end, and means for biasing said first end of said lid to engage with said housing, said first end of said lid being allowed to be depressed inward of said housing against said biasing means, said rod being allowed to be rotated to align said at least one tool bit with said lid, and said at least one tool bit being allowed to be tilted by said lid when said first end of said lid is depressed inward of said housing against said biasing means.

2. The tool handle according to claim 1, wherein said lid includes a block provided in said first end and includes a pair of shoulders for engaging with said housing, said biasing means biases said block to engage with said housing for allowing said block and said first end of said lid to be depressed inward of said housing.

3. The tool handle according to claim 1 further comprising means for rotating said rod.

4. The tool handle according to claim 3, wherein said rod includes an extension extended outward of said housing, said rotating means includes a control ferrule secured to said extension for rotating said rod and for aligning said at least one tool bit with said lid.

5. The tool handle according to claim 1 further comprising a cap rotatably secured to said control ferrule for shielding said extension.

6. The tool handle according to claim 1 further comprising means for rotatably securing said rod to said housing.

7. The tool handle according to claim 6, wherein said rotatably securing means includes a retainer secured in said housing, said rod includes a cavity rotatably engaging with said retainer for allowing said retainer to rotatably secure said rod to said housing.

8. The tool handle according to claim 1 further comprising means for positioning said rod to said housing.

9. The tool handle according to claim 8, wherein said lid includes a second end having a projection, said rod includes a first end having a head, said head includes an outer peripheral surface having at least one depression for engaging with said projection of said lid and for positioning said rod relative to said housing.

* * * * *